US009567842B2

(12) United States Patent
Wilfing et al.

(10) Patent No.: US 9,567,842 B2
(45) Date of Patent: Feb. 14, 2017

(54) RADIAL FISHBONE SAGD

(71) Applicants: Total E&P Canada, Ltd., Calgary (CA); ConocoPhillips Canada Resources Corp., Calgary (CA); ConocoPhillips Surmont Partnership, Calgary (CA)

(72) Inventors: Kevin A. Wilfing, Cochrane (CA); John L. Stalder, Houston, TX (US)

(73) Assignees: Total E&P Canada Ltd, Calgary (CA); ConocoPhillips Resources Corp., Calgary (CA); ConocoPhillips Surmont Partnership, Calgary (CA)

( * ) Notice: Subject to any disclaimer, the term of this patent is extended or adjusted under 35 U.S.C. 154(b) by 365 days.

(21) Appl. No.: 14/227,826

(22) Filed: Mar. 27, 2014

(65) Prior Publication Data

US 2014/0345855 A1 Nov. 27, 2014

Related U.S. Application Data

(60) Provisional application No. 61/825,945, filed on May 21, 2013.

(51) Int. Cl.
*E21B 43/30* (2006.01)
*E21B 43/24* (2006.01)

(52) U.S. Cl.
CPC ..... *E21B 43/305* (2013.01); *E21B 43/2406* (2013.01)

(58) Field of Classification Search
CPC ..... E21B 43/305; E21B 43/2406; E21B 43/30
See application file for complete search history.

(56) References Cited

U.S. PATENT DOCUMENTS 4,676,313 A * 6/1987 Rinaldi ..... E21B 43/12 166/250.15
5,016,709 A * 5/1991 Combe ..... E21B 43/305 166/245
5,242,025 A * 9/1993 Neill ..... E21B 7/04 175/26
5,785,133 A * 7/1998 Murray ..... E21B 7/061 166/117.5
6,050,335 A * 4/2000 Parsons ..... E21B 43/305 166/263
6,119,776 A * 9/2000 Graham ..... E21B 43/17 166/245

(Continued)

FOREIGN PATENT DOCUMENTS

WO 2009025574 2/2009

OTHER PUBLICATIONS

Stalder J.L., et al., Alternative Well Configurations in SAGD: Rearranging Wells to Improve Performance, presented at 2012 World Heavy Oil Congress.

(Continued)

*Primary Examiner* — Jennifer H Gay
(74) *Attorney, Agent, or Firm* — Boulware & Valoir

(57) ABSTRACT

The present disclosure relates to a particularly effective well configuration that can be used for SAGD and other steam based oil recovery methods. A central wellpad originates injector and/or producer wells, arranged in a radial pattern, and either or both provided with multilateral wells, thus effectively expanding the coverage.

15 Claims, 8 Drawing Sheets

(56) References Cited

U.S. PATENT DOCUMENTS

| | | | | |
|---|---|---|---|---|
| 6,662,870 | B1 * | 12/2003 | Zupanick | E21B 7/046 166/245 |
| 7,360,595 | B2 * | 4/2008 | Zupanick | E21B 41/0064 166/245 |
| 8,291,974 | B2 * | 10/2012 | Zupanick | B65G 5/00 166/245 |
| 8,333,245 | B2 | 12/2012 | Zupanick | |
| 8,376,052 | B2 | 2/2013 | Zupanick | |
| 8,517,091 | B2 * | 8/2013 | Bahorich | E21B 43/30 166/245 |
| 9,260,921 | B2 * | 2/2016 | Graham | E21B 7/046 |
| 9,291,042 | B2 * | 3/2016 | Lamb | E21B 43/24 |
| 2002/0096336 | A1 * | 7/2002 | Zupanick | E21B 7/046 166/370 |
| 2005/0087340 | A1 * | 4/2005 | Zupanick | E21B 41/0064 166/245 |
| 2008/0060804 | A1 * | 3/2008 | Zupanick | B65G 5/00 166/245 |
| 2009/0255661 | A1 * | 10/2009 | Clark | E21B 41/0035 166/50 |
| 2009/0288833 | A1 * | 11/2009 | Graham | E21B 7/046 166/306 |
| 2011/0036576 | A1 | 2/2011 | Schultz | |
| 2011/0067858 | A1 | 3/2011 | Dreher | |
| 2012/0227966 | A1 | 9/2012 | Dreher | |
| 2012/0247760 | A1 | 10/2012 | Wheeler | |
| 2013/0105147 | A1 * | 5/2013 | Scott | E21B 43/14 166/245 |
| 2013/0146284 | A1 * | 6/2013 | Ayasse | E21B 43/305 166/256 |
| 2013/0153215 | A1 * | 6/2013 | Scott | E21B 43/2406 166/252.1 |
| 2013/0333885 | A1 * | 12/2013 | Carrizales | E21B 43/24 166/272.3 |
| 2014/0020891 | A1 * | 1/2014 | Lamb | E21B 43/24 166/272.6 |
| 2014/0262220 | A1 * | 9/2014 | Guerrero | E21B 47/00 166/245 |
| 2014/0345855 | A1 * | 11/2014 | Wilfing | E21B 43/305 166/245 |
| 2014/0345861 | A1 * | 11/2014 | Stalder | E21B 43/16 166/268 |
| 2015/0096748 | A1 * | 4/2015 | West | E21B 43/086 166/272.3 |
| 2015/0198019 | A1 * | 7/2015 | Affholter | E21B 43/24 166/272.6 |
| 2015/0198022 | A1 * | 7/2015 | Stanecki | E21B 43/24 166/272.3 |

OTHER PUBLICATIONS

Lougheide et al., OTC 16244, Trinidad's First Multilateral Well Successfully Integrates Horizontal Openhole Gravel Packs, OTC (2004).

Stalder, SPE 69700-MS, "Multilateral-Horizontal Wells Increase Rate and Lower Cost Per Barrel in the Zuata Field, Faja, Venezuela", Mar. 12, 2001.

Husain et al., EME 580 Final Report: Economic Comparison of Multi-Lateral Drilling over Horizontal Drilling for Marcellus Shale Field (2011).

U.S. Appl. No. 14/173,267, "Fishbone SAGD", Inventors:John L. Stalder; Son V. Pham, filed Feb. 5, 2014.

* cited by examiner

RADIAL FISHBONE SAGD

PRIORITY CLAIM

This application claims priority to 61/825,945, filed May 21, 2013, and expressly incorporated by reference herein for all purposes.

FIELD OF THE DISCLOSURE

This disclosure relates generally to well configurations that can advantageously produce oil using steam based mobilizing techniques. In particular, a radial fishbone arrangement of injectors and producers with fishbone ribs is described.

BACKGROUND OF THE DISCLOSURE

Oil sands are a type of unconventional petroleum deposit that contain naturally occurring mixtures of sand, clay, water, and a dense and extremely viscous form of petroleum technically referred to as "bitumen," but which may also be called heavy oil or tar. Many countries have large deposits of oil sands, including the United States, Russia, and various countries in the Middle East, but the world's largest deposits occur in Canada and Venezuela.

Bitumen is a thick, sticky form of crude oil, so heavy and viscous that it will not flow unless heated or diluted with lighter hydrocarbons. At room temperature, bitumen is much like cold molasses. Often times, the viscosity can be in excess of 1,000,000 cP.

Due to their high viscosity, these heavy oils are hard to mobilize, and they generally must be made to flow in order to produce and transport them. One common way to heat bitumen is by injecting steam into the reservoir. The quality of the injected fluid is very important to transferring heat to the reservoir to allow bitumen to be mobilized. Quality in this case is defined as percentage of the injected fluid in the gas phase. The target fluid quality is near 100% vapor, however, injected fluid in parts of the well can have a quality below 50 percent (more than 50% liquid) due to heat loss along the wellbore.

Steam Assisted Gravity Drainage (SAGD) is the most extensively used technique for in situ recovery of bitumen resources in the McMurray Formation in the Alberta Oil Sands and other reservoirs containing viscous hydrocarbons. In a typical SAGD process, two horizontal wells are vertically spaced by 4 to 10 meters (m). The production well is located near the bottom of the pay and the steam injection well is located directly above and parallel to the production well. In SAGD, steam is injected continuously into the injection well, where it rises in the reservoir and forms a steam chamber.

With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within the steam chamber.

This use of gravity gives SAGD an advantage over conventional steam injection methods. SAGD employs gravity as the driving force and the heated oil remains warm and movable when flowing toward the production well. In contrast, conventional steam injection displaces oil to a cold area where its viscosity increases and the oil mobility is again reduced.

Although quite successful, SAGD does require enormous amounts of water in order to generate a barrel of oil. Some estimates provide that 1 barrel of oil from the Athabasca oil sands requires on average 2 to 3 barrels of water, although with recycling the total amount can be reduced to 0.5 barrel. In addition to using a precious resource, additional costs are added to convert those barrels of water to high quality steam for downhole injection. Therefore, any technology that can reduce water or steam consumption has the potential to have significant positive environmental and cost impact.

One concept for reducing water consumption is the "multilateral" or "fishbone" well configuration idea. The concept of fishbone wells for non-thermal horizontal wells was developed by Petrozuata in Venezuela in 1999. That operation was a cold, viscous oil development in the Faja del Orinoco Heavy Oil Belt. The basic concept was to drill open-hole side lateral wells or "ribs" off the main spine of a producing well prior to running slotted liner into the spine of the well (FIG. 1).

A variety of multilateral well configurations are possible (see FIG. 2). Such ribs appear to significantly contribute to the productivity of the wells when compared to wells without the ribs in similar geology (FIG. 3).

The advantages of multilateral wells include:

1) Higher Production. In the cases where thin pools are targeted, vertical wells yield small contact with the reservoir, which causes lower production. Drilling several laterals in thin reservoirs and increasing contact improves recovery.

2) Decreased Water/Gas Coning. Coning is aggravated by pressure gradients that exceed the gravity forces that stabilize the fluid contacts (oil/water or gas/water). The position of the laterals within the producing formation provides enough distance to the water zone and to the gas zone to facilitate higher withdrawal rates and lower pressure gradients. Therefore, gas/water coning can be prevented or reduced.

3) Improved sweep efficiency. By using multilateral wells, the sweep efficiency may be improved and/or the recovery may be increased due to the area covered by the laterals.

4) Faster Recovery. The reservoir contact is higher in multilateral wells leading to increased production rates than that of single vertical or horizontal wells.

5) Decreased environmental impact. To the extent that the overall length of wells is reduced by sharing mother-bores, the volume of consumed drilling fluids and the generated cuttings during drilling multilateral wells can be reduced. Additionally, there may be a reduction of wellpad number. Therefore, the impact of the multilateral wells on the environment may be reduced.

6) Saving time and cost. Drilling several laterals in a single well will result in substantial time and cost saving in comparison with drilling several wells in the reservoir.

Lateral wells have been used for various methods in the patent literature. For example, EP2193251 discloses a method of drilling multiple short laterals that are of smaller diameter, and these multiple short laterals can be drilled at the same depth from the same main wellbore, so as to perform treatments in and from the small laterals to adapt or correct the performance of the main well, the formation properties, the formation fluids and the change of porosity and permeability of the formation. However, the short laterals do not address the issue where the prism or wedge between two adjacent SAGD well pairs is hard to produce/deplete.

US20110036576 discloses a method of injecting a treatment fluid through a lateral injection well such that the hydrocarbon can be treated by the treatment fluid before production. However, the addition of treatment fluid is known in the field and this well configuration does not increase the contact with the hydrocarbon reservoir.

Although a potential improvement, the multilateral well methods can have disadvantages too. One disadvantage is that fishbone wells are more complex to drill and clean up. Indeed, some estimate that multilaterals cost about 20% more to drill and complete than conventional slotted liner wells. Another disadvantage is increased risk of accident or damage, due to the complexity of the operations and tools. Sand control can also be difficult. In drilling multilateral wells, the mother well bore can be cased to control sand production, however, the legs branched off the mother well bore are typically open hole. Therefore, the sand control from the branches is not easy to perform. There is also increased difficulty in modeling and prediction due to the sophisticated architecture of multilateral wells.

Another area of uncertainty with the fishbone concept is whether the ribs will establish and maintain communication with the offset steam chambers, or will the open-hole ribs collapse early and block flow. One of the characteristics of the Athabasca Oil Sands is that they are unconsolidated sands that are bound by the million-plus centipoise bitumen. When heated to 50-80° C. the bitumen becomes slightly mobile. At this point the open-hole rib could collapse. If so, flow would slow to a trickle, temperature would drop, and the rib would be plugged. However, if the conduit remains open at least long enough that the bitumen in the near vicinity is swept away with the warm steam condensate before the sand grains collapse, then it may be possible that a very high permeability, high water saturation channel might remain even with the collapse of the rib. In this case, the desired conduit would still remain effective.

Another uncertainty with many ribs along a fishbone infill producer of this type is that one rib may tend to develop preferentially at the expense of all the other ribs leading to very poor conformance and poor results. This would imply that some form of inflow control may be warranted along the fishbone infill liner to encourage more uniform development of all the ribs.

Therefore, although beneficial, the multilateral well concept could be further developed to address some of these disadvantages or uncertainties.

SUMMARY OF THE DISCLOSURE

The disclosure relates to well configurations that are used to maximize steam recovery of oil, especially heavy oils, and reduce land disturbance, surface footprint, and number of wells. In general, a radial fishbone-like well pattern includes a radial arrangement of injector and producer wells, with ribs or lateral wells projecting from either type of well, thus ensuring maximal recovery and minimal water usage. Preferably, the ribs are drilled from the production wells, as this provides the greatest mobilized oil collection area, but ribs can be provided on either or both well types.

In preferred configurations, fishbone production wells are drilled radially outward from the surface drilling pad and non-fishbone injection wells are drilled between the spine liners of the producers to effect a more or less circular (or hexagonal or other drainage area packing geometry) SAGD operation.

The injector wells and producer wells can be vertically stacked, as is typically in SAGD, or not, as desired. The injector wells can also be horizontally offset from vertical stacking to a much greater degree with the use of laterals that curve upwards to meet or nearly meet a nearest offset stacked injector. This allows a reduction in the number of injector wells, since an injector well could service two production wells (one on either side). It is even possible to use wells at or near the same level when the radial pattern is employed, because the lateral offset allows steam trap control.

The density and lengths of open-hole ribs may be varied to suit the particular environment. In particular, the ribs toward the toes of the wells would be longer than the ribs near the heels of the wells due to the increasing circumferential arc lengths as radius from the drilling pad increases toward the toe. Furthermore, the spacing between the ribs may decrease as radial distance from the drilling pad increases so as to provide more even distribution of the drained area per rib associated with the fishbone wells.

Additionally, the spacing between injectors and producers, both vertically and laterally, in the pay section may be optimized for the particular reservoir conditions. The open-hole ribs may be horizontal or curved in the vertical dimension to optimize performance.

It may be possible to completely eliminate conventional steam circulation for preheating that is required for conventional SAGD, especially where lateral well coverage reaches from the production wells to the injector wells, thus establishing immediate or nearly immediate fluid communication.

Flow distribution control may be used in either or both the injectors and producers to further optimize performance along all the ribs so as to counter the tendency for the shorter ribs near the heel from dominating performance, and to potentially lower the development cost. Because it is known in the art, the flow distribution control will not be discussed in detail herein. However, different flow distribution control mechanisms may be employed in the present disclosure for better thermal efficiency and/or production of SAGD. For example, flow distribution control built into the liner could eliminate the toe tubing and achieve the target flow capacity with a smaller liner and reduce the amount of steel placed in the ground. The cost saving of smaller liners and casing, and the elimination of the toe tubing string could offset the added cost of flow distribution control even without considering the upside of better performance from the wells.

One method commonly used to improve flow distribution within a horizontal well is to use several throttling devices distributed along the horizontal completion, such as using orifices, to impose a relatively high pressure drop at exit or entry points compared to the pressure drop for flow inside the base pipe. In this case, the toe tubing string can be eliminated from the base pipe, with the caveat that limited remediation is available if needed. If, alternatively, the flow distribution control devices are installed on a toe tubing string that can be removed for servicing when needed, it is less likely that the size of liner can be reduced.

The disclosure includes any one or more of the following embodiments, in any combination thereof:

A well configuration for steam assisted gravity drainage (SAGD) production of hydrocarbons, the well configuration comprising a central well pad; a plurality of horizontal production wells radiating from said central well pad at a first depth at or near the bottom of a hydrocarbon play; a plurality of horizontal injection wells radiating from said central well pad at a lesser depth than said first depth; a plurality of lateral wells originating from said plurality of horizontal production wells or said plurality of horizontal injection wells or both.

A well configuration wherein said plurality of lateral wells originate from each of said plurality of horizontal production wells.

A well configuration for steam production of hydrocarbons, the well configuration comprising a central well pad; a plurality of horizontal production wells radiating from said central well pad; a plurality of horizontal injection wells radiating from said central well pad; a plurality of lateral wells originating from said plurality of horizontal production wells or said plurality of horizontal injection wells or both.

A well configuration wherein said plurality of lateral wells originate from each of said plurality of horizontal production wells and slant upwards towards said plurality of horizontal injection wells.

A well configuration wherein said plurality of lateral wells are arranged in an alternating pattern.

A well configuration wherein wellpairs are vertically stacked or offset stacked, or alternating at or near the same depth.

A well configuration wherein said plurality of lateral wells originate from each of said plurality of horizontal production wells and are arranged in an alternating pattern.

A well configuration wherein said plurality of lateral wells originate from each of said plurality of horizontal production wells and are arranged in an alternating pattern and slant upwards.

An improved method of SAGD, SAGD comprising a lower horizontal production well, a higher horizontal injection well, wherein steam is injected into said injection well to mobilize oil which then gravity drains to said production well, the improvement comprising providing a central wellpad having a radial array of a plurality of lower horizontal production wells and a plurality of higher horizontal injection wells, said plurality of lower horizontal production wells each also having a plurality of lateral wells extending upwards towards a nearest higher horizontal injection well.

An improved method of SAGD, SAGD comprising a lower horizontal production well, a higher horizontal injection well, wherein steam is injected into said injection well to mobilize oil which then gravity drains to said production well, the improvement comprising providing a central wellpad having a radial array of alternating lower horizontal production wells and higher horizontal injection wells, each of said lower horizontal production wells each also having a plurality of lateral wells.

An improved method of SAGD, SAGD comprising a lower horizontal production well, a higher horizontal injection well, wherein in a preheat step a) steam is injected into each of said wells until fluid communication is established between wells, wherein after the preheat step steam is injected into said injection well to mobilize oil which then gravity drains to said production well for production, the improvement comprising providing a central wellpad having a radial array of alternating lower horizontal production wells and higher horizontal injection wells, said lower horizontal production wells each also having a plurality of lateral wells extending upwards towards a nearest higher horizontal injection well, and wherein the preheat step is greatly reduced (at least 90% reduced) or even eliminated.

An improved method of SAGD, SAGD comprising a horizontal production well, a horizontal injection well, wherein in a preheat step a) steam is injected into each of said wells until fluid communication is established between wells, wherein after the preheat step steam is injected into said injection well to mobilize oil which then gravity drains to said production well for production, the improvement comprising providing a central wellpad having a radial array of horizontal production wells and horizontal injection wells, said horizontal production wells each also having a plurality of lateral wells extending towards a nearest horizontal injection well, and wherein the preheat step is greatly reduced or eliminated.

An improved method of steam assisted oil production, wherein in a preheat step a) steam is injected into each of said wells until fluid communication is established between wells, wherein after the preheat step steam is injected into said injection well to mobilize oil, which is then driven to said production well for production, the improvement comprising providing a radial fishbone pattern of radially arranged alternating production wells and injection wells, some of said wells each also having a plurality of lateral wells extending towards a nearest neighbor well, and wherein the preheat step a) is greatly reduced.

A method of SAGD production of hydrocarbons, said method comprising providing a well configuration as described herein; injecting steam into each of said plurality of injection wells; heating hydrocarbons to produce mobilized hydrocarbons; and producing said mobilized hydrocarbons from said production wells.

"Vertical" drilling is the traditional type of drilling in oil and gas drilling industry, and includes well <45° of vertical.

"Horizontal" drilling is the same as vertical drilling until the "kickoff point" which is located just above the target oil or gas reservoir (pay zone), from that point deviating the drilling direction from the vertical to horizontal. By "horizontal" what is included is an angle within 45° (≤45°) of horizontal.

"Multilateral" wells are wells having multiple branches (laterals) tied back to a mother wellbore (also called the "originating" well), which conveys fluids to or from the surface. The branch or lateral may be vertical or horizontal, or anything therebetween. These lateral wells are referred to as "ribs" herein.

A "radial pattern" as used herein means that wells originate at or near a central well pad and radiate outwardly therefrom, in a manner similar to the frame threads of a spiders web.

A "lateral" well as used herein refers to a well that branches off an originating well. An originating well (or mother well) may have several such lateral wells (together referred to as multilateral wells), and the lateral wells themselves may also have lateral wells.

An "alternate pattern" or "alternating pattern" as used herein means that subsequent lateral wells alternate in direction from the originating well, first projecting to one side, then to the other. An example is shown in FIGS. 1 and 4.

As used herein a "slanted" well with respect to lateral wells, means that the well is not in the same plane as the originating well, but travels upwards or downwards from same.

A "vertically stacked" wellpair means that the upper injection well is roughly directly overhead of the lower production well (+/−10°).

The wellpairs can also be offset such that although the injectors are higher than producers, an injector is not directly overhead a producer, but offset in the horizontal direction. Such wells are "stacked" since one is higher, but not vertically stacked. Such wellpairs are called "offset stacked" wellpairs herein.

Wells can also be at or near the same depth, herein, since the lateral offset is sufficient for gravity drainage and steam trap maintenance.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the disclosure.

The following abbreviations are used herein:

| | |
|---|---|
| SAGD | Steam Assisted Gravity Drainage |
| CHOPS | Cold Heavy Oil Production with Sand |

DESCRIPTION OF EMBODIMENTS OF THE DISCLOSURE

The present disclosure provides a novel well configuration for SAGD oil production, which we refer to herein as a "radial fishbone" configuration, wherein all injectors and producers radiate outward from a single pad, and the wells have ribs covering the area therebetween.

Although particularly beneficial in gravity drainage techniques (e.g., with vertically stacked or offset stacked well pairs), this is not essential and the configuration could be used for horizontal sweeps as well. Thus, the upper injection wells could be eliminated and/or level with production wells. Of course, an injection well can also be used as a production well once fluid communication is established.

The well configuration can be used in any enhanced oil recovery techniques, including cyclic steam stimulations, SAGD, expanding solvent SAGD, polymer sweeps, water sweeps, and the like.

The ribs can be placed in any arrangement known in the art, depending on reservoir characteristics and the positioning of nonporous rocks and the play. Ribs can originate from producers or injectors or both, but preferably originate from the producers as this provides the maximal hydrocarbon collection area.

The ribs can be planar or slanted. The ribs can also have further ribs, if desired. The rib arrangement on a particular well can be pinnate, alternate, radial, or combinations thereof.

In this instance, it is proposed that steam could be injected into the injection wells (with or without fishbones) and steam condensate could be produced from the fishbone production well provided that the open-hole ribs that have been drilled to cover the intervening space and are initially filled with drilling fluid (water) which has a very high mobility due to the open-hole and the low viscosity of water.

We have shown the ribs reaching nearly to the level of the injection well, albeit staggered therefrom, and this is desirable as adequately covering the intervening space. The ribs can also pass the plane of the injection well.

Methods for drilling multilateral ribs are well known in the field, and therefore will not be discussed in detail herein.

Flow distribution control may be used in either or both the injector and producer well(s) to effect better fluid flow patterns throughout the process.

Once the heated fluids flow from the injection wells through the open-hole ribs to the open-hole ribs and into the liner(s) of the producing well(s), a preheating effect will occur. This will occur without the conventional steam circulation of 3-4 months, which simplifies the well operation and surface facility.

Figure 7:
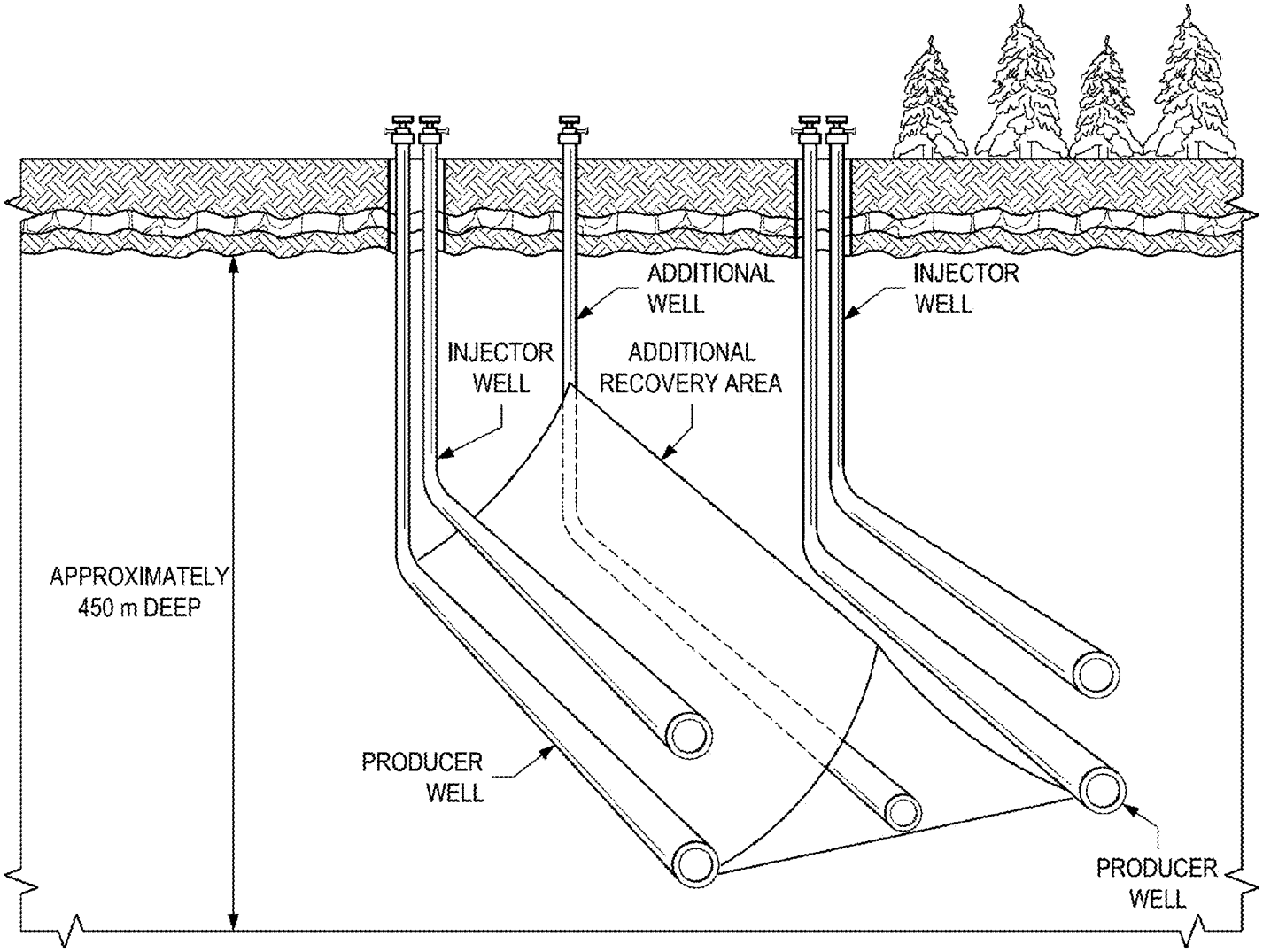
FIG. 7 shows the prism or wedge between two traditional SAGD well pairs that is difficult to produce without additional drilling.

Over time the heated regions will expand due to heat transfer and bitumen will become mobilized and SAGD chamber(s) will develop as in conventional SAGD. However, conventional SAGD typically is slow to deplete a triangular prism (referred to as "wedge" in certain literature) midway between a pair of well pairs. FIG. 7 shows a pair of well pairs, with a $5^{th}$ additional well placed between two existing well pairs to recover this "wedge" of previously unrecovered oil. However, drilling an additional well means adding a significant amount of drilling and operational cost for production.

The radial fishbone SAGD concept proposed herein eliminates this wedge and accelerates recovery between the liners of the adjacent wells. In particular, with the radial configuration, it may be possible to increase lateral spacing between wells greatly in the toe regions and still achieve more rapid production of the resource while allowing a lower steam consumption. Furthermore, well pairs can be (but don't have to be) replaced by single wells in this concept so that the number of wells may be cut in half or further.

The key is the spacing and length of the ribs attached to each of the wells. Petrozuata experience in Venezuela indicated that fishbone wells cost about 20% more to drill and complete than conventional slotted liner wells. However, in SAGD, if radial fishbone SAGD wells reduce well count to half or less, there is a clear overall cost savings as well as the performance benefits mentioned earlier.

Furthermore, the radial drilling configuration simplifies the directional drilling trajectories such that it should be possible to drill longer wells than currently possible with the rectangular drainage areas used in classical SAGD. Classical SAGD pads, with parallel well pairs, require a compound drilling trajectory from the surface pad to the heel of the well. This extra curvature places much higher torque and drag on the drilling string, as well as increased drag when running the liner. These effects limit both the length of drilled reach and the length of liner that can be installed. The radial configuration eliminates the compound trajectory and leaves a very simple, single plane, directional drilling path with less torque and drag problems.

The total area drained from a single drilling pad could be increased over 8 fold compared to current rectangular pad developments. This would reduce pad count for a development, although the pads would have bigger piping and fluid handling equipment than the smaller conventional pads. There would be economy of scale benefits for this change as well as significant surface footprint savings overall.

Figure 1:
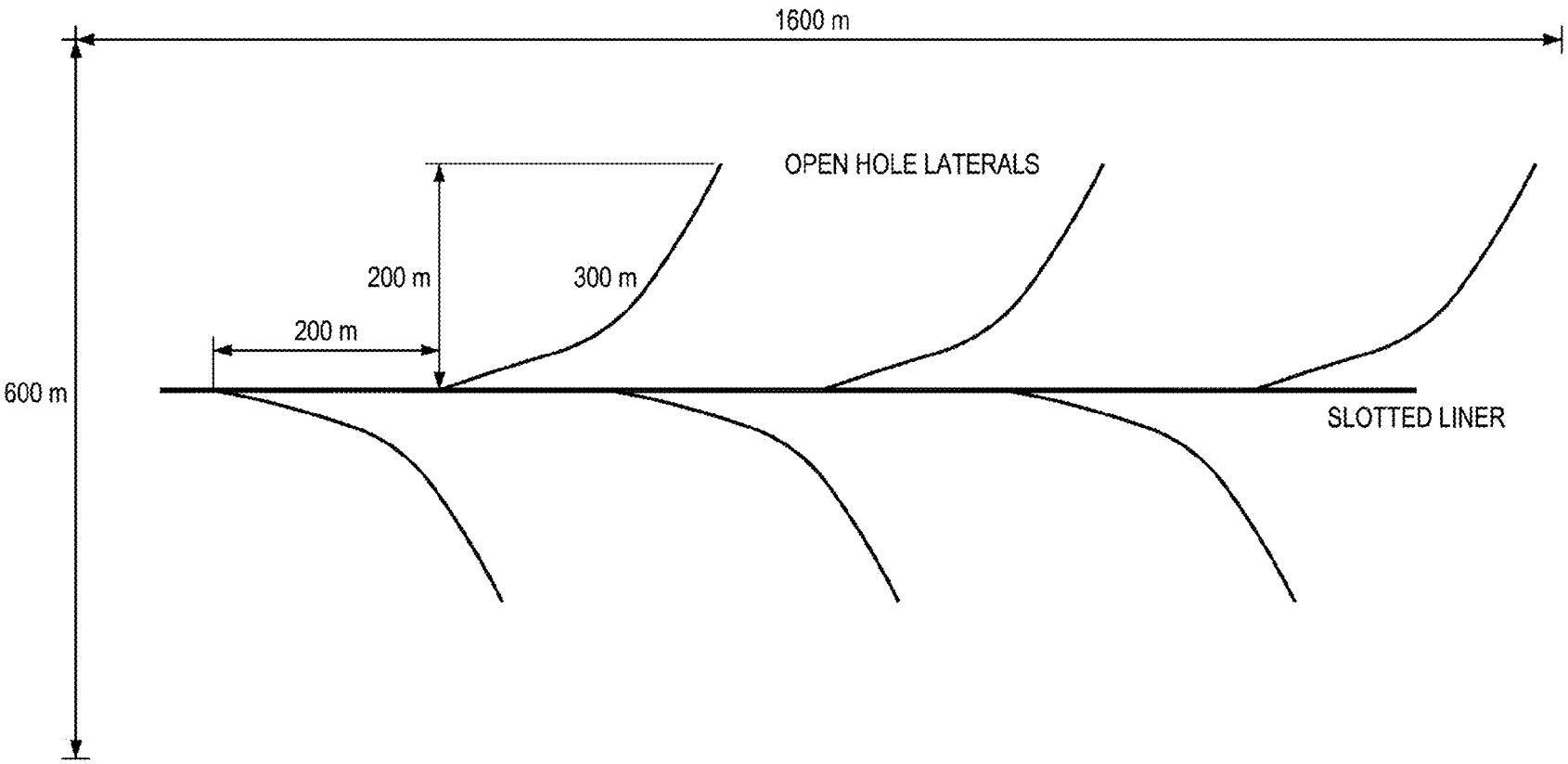
FIG. 1 (PRIOR ART)
FIG. 1 displays the original "fishbone" well configuration concept with a 1200 m horizontal slotted liner (center line) with associated open hole "ribs" draining a 600×1600 m region. The original concept was tested only in a cold well, and was not used with steam.
Figure 2:
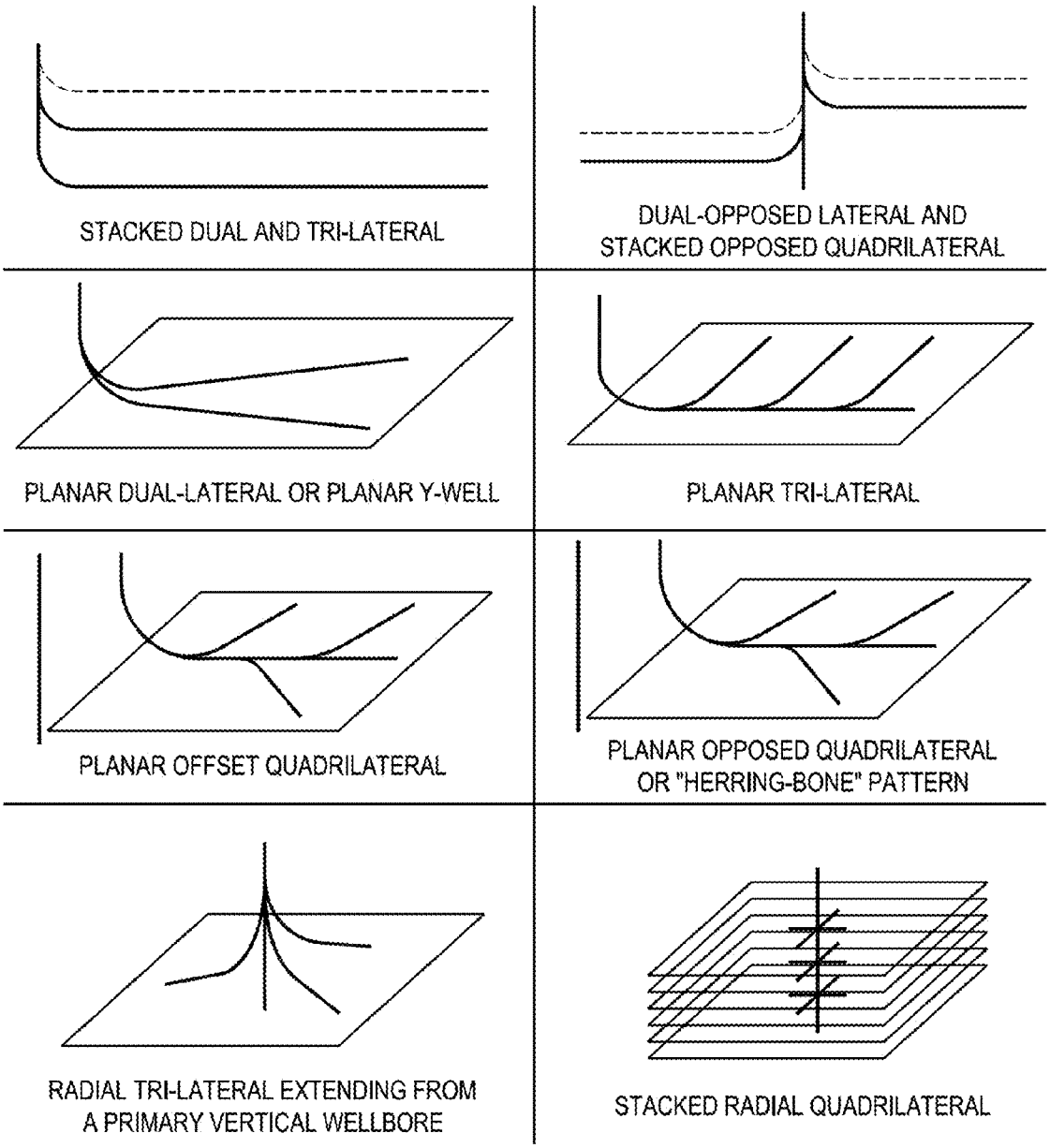
FIG. 2 (PRIOR ART)
FIG. 2 shows a variety of multilateral well configurations, but additional variations are also possible.
Figure 3:
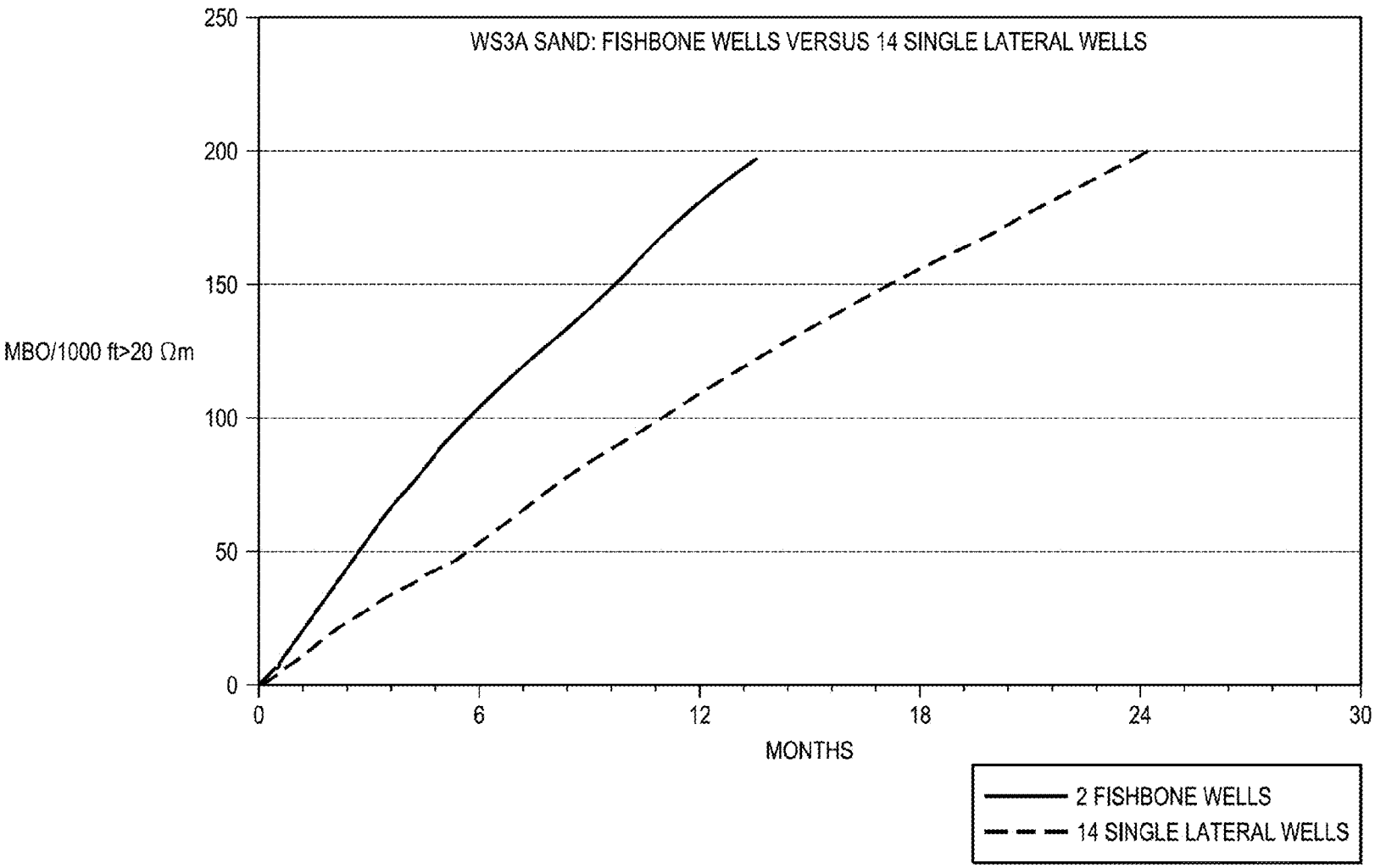
FIG. 3 (PRIOR ART)
FIG. 3 shows production over time of two fishbone wells compared against 14 single wells. The fishbone wells' higher rate per 1000 feet of net pay measured along the spine shows that ribs boost productivity over single laterals.
Figure 4:
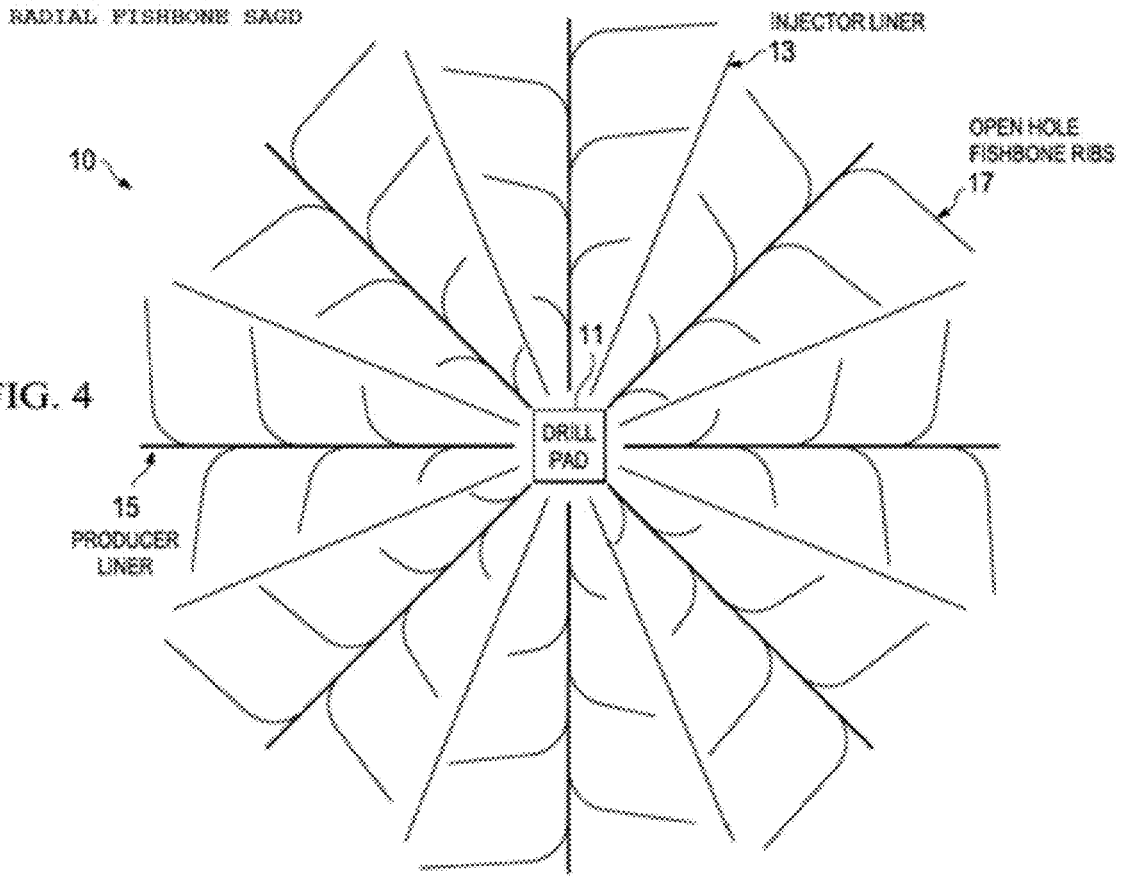
FIG. 4 is a top view schematic of the "radial fishbone" well configuration used to maximize oil recovery and reduce water usage. The vertical portions of the wells inside the heel are omitted from the drawing for simplicity.

FIG. 4 is a top view of an exemplary radial fishbone SAGD well arrangement 10, wherein a central wellpad 11 has alternating radiating injector wells 13 and production wells 15, wherein in this instance the production well 15 have a plurality of multilateral wells 17 or ribs. Such arrangement provides nearly immediate fluid communication if the ribs reach sufficiently from one producer to an adjacent injector. Thus, the steam preheat is reduced or even eliminated. Furthermore, fewer wells allow coverage of a given area.

It is noted that the number of injector wells and producer wells in a given drill pad may vary due to various reasons, such as limited drill pad space for additional equipment. In that instance, the well configuration can be easily altered such that fewer injector and producer wells are drilled, while more and longer ribs 17 are drilled to cover the reservoir.

Figure 5:
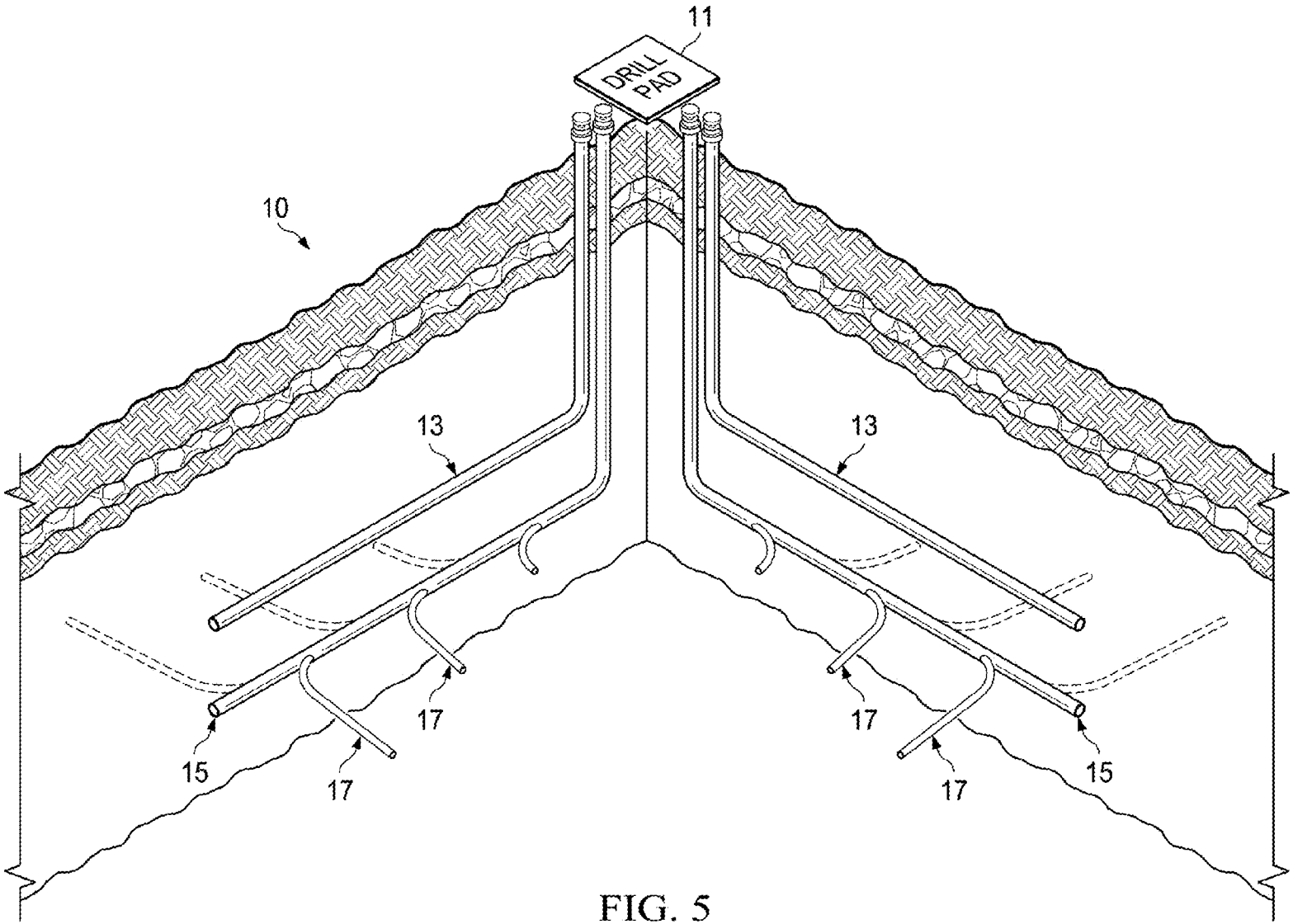
FIG. 5 shows the well configuration of FIG. 4 in a cross sectional view, wherein the ribs are planar.

FIG. 5 shows a cross sectional view of the wells of FIG. 4, wherein the ribs 17 are planar. As shown in the drawing, the vertical main well bore is drilled from the drill pad 11, and the producer wells 15 have multiple planar ribs 17. These lateral ribs 17 can be different in length, radius or location along the producer well 15, as long as the drilling technique and geological conditions allow. In general, the length of the ribs 17 increases as the lateral producer wells 15 extends further away from the drill pad 11, such that more area of the reservoir can be reached with minimum number of wells drilled from the drill pad 11.

Figure 6:
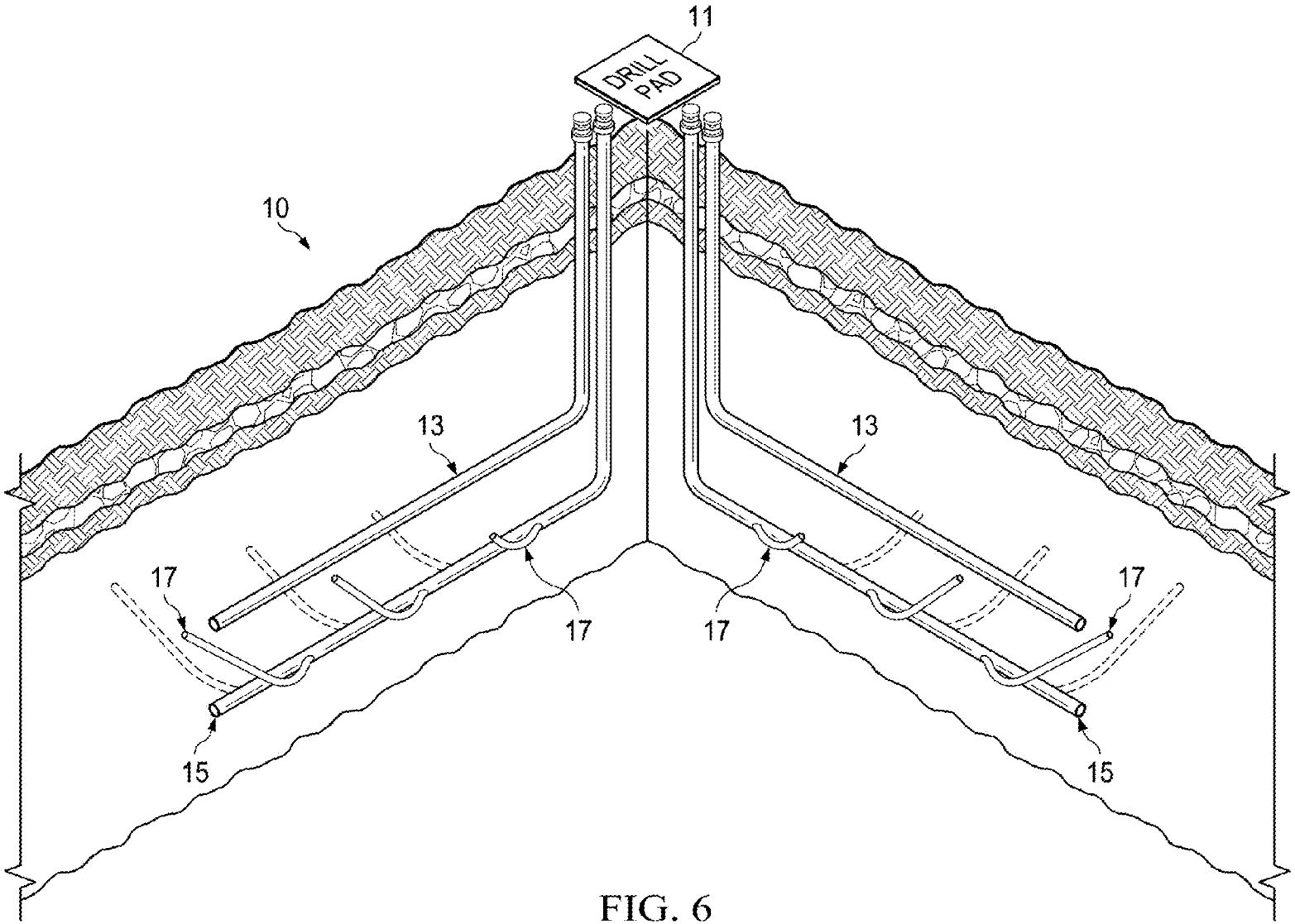
FIG. 6 shows the well configuration of FIG. 4 in a cross sectional view, wherein the ribs are slanted towards the upper injection wells.

FIG. 6 shows the same cross section of FIG. 4, wherein the ribs 17 are slanting upwards from the producer wells 15 towards the injector wells 13. Similar to the embodiments illustrated in FIG. 5, the length, radius or location of the ribs may vary. Combinations of planar and slanted wells are also possible.

Sand production occurs with heavy oil production in unconsolidated sand formations. If sand production is stopped with screens or filters, this often results in near total loss of production from the well. With the use of progressive cavity pumps, sand production can be encouraged, resulting in sand cuts that can be as high as 30-40% initially before dropping to about 5%. The production of sand results in open holes, also called wormholes, that stretch into the formation away from the well. The productivity of the well rises from the average 4 to 5 $m^3/d$ to as high as 15 to 20 $m^3/d$ as the wormholes form high permeability conduits for flow of oil and more sand. This production process is called Cold Heavy Oil Production with Sand (CHOPS).

For steam circulation to be efficient, wormholes grow from the low-pressure tip of the wormhole toward the higher-pressure source, either native reservoir or injection point or influx source such as an aquifer. In other words, the matrix material in the pay zone has to be moved or transported to allow the wormhole to grow. With a rib drilled from the injector, where the pressure is high, it is expected that the sand at the tip of the rib cannot move because it jams against undisturbed matrix material around it. On the other hand, heated oil near the root of the rib at the injection liner will soften and allow sand in the region to become "uncemented" and mobile. Such mobilized sand will move through the rib until it is blocked by the matrix and then "screen out" and start plugging back the tip of the rib and continue plugging back toward the root of the rib near the injection well liner. Eventually the ribs could be completely shut.

Ribs drilled from producers, on the other hand, are expected to have considerable "accommodation space" for sand that moves from the tip of the rib back toward the production well liner where the sand will either settle along the open hole ribs or screen out against the producer liner sand exclusion media. Assuming that the distance from the tip of the producer rib to the nearest neighboring injection liner is 10 meters, because of wormhole growth tending to follow the sharpest pressure gradient, this is the likely path for wormhole to extend the producer rib tip toward the injector.

As an example, supposing the open hole rib length from the producer liner to the rib tip is on the order of 150 meters due to the build radius and the directional drilling method, the 10 meters of matrix between the rib tip and the injector will easily be accommodated by the 150 meters of open hole from the rib tip to the producer liner, so that a wormhole can easily grow to connect the producer rib tip with the injector. Based on CHOPS observations, this can happen before significant heating takes place, and we can establish a high water saturation fluid flow connection as early as steam is injected and steam condensate flows through the drilling mud filled ribs toward the producer. As injection progresses the wormholes will connect, flow capacity will increase, and hot fluids can flow, thereby allowing the elimination of the usual preheat circulation in SAGD operations.

In use, steam can be injected into all wells for a brief period to establish fluid communication. Alternatively, steam can be injected only into injectors. Once the oil is mobilized and drains to the producers, it can then be produced.

As illustrated above, the radial fishbone SAGD well configuration of this disclosure has several advantages over prior art. First, this radial fishbone SAGD well configuration can reduce or even eliminate preheat circulation that typically takes 3 months before the production begins. This is because the distance between the injector wells and the ribs of the producer wells (or vice versa) has been greatly reduced. The open-hole ribs allow better steam/condensate circulation with the producer wells. The steam injected through the injection well will condense, and the steam condensate could be produced from the fishbone production well because the open-hole ribs nearly reach, reach, or even intersect with the injection wells (or ribs thereof).

Eliminating the conventional 3-month steam circulation reduces the equipment and surface space needed for the preheating circulation. Also, the steam trap control is different from those used in classical SAGD, and may also contribute to water saving.

Classical SAGD relies on the injection well being above the producer so that steam trap control is achieved by gravity forces that discourage the gas phase from moving vertically downward and that encourage the liquid phase to move vertically downward. Countering these forces are viscous forces and pressure gradients that may cause the gas phase to move downward, against gravity, due to sheer pressure difference and high mobility over a very short (5 meter) path.

By moving the injector and producer apart laterally these same forces produce a different effect whereby the gas will rise by gravity and the liquid fall by gravity; however, the pressure gradient between the wells is now not just 5 meters vertically, but could be as much as 30 to 100 m laterally. This represents a huge reduction in the gradient so that gravity override can occur as steam moves laterally from the injector (or an injector rib) toward the producer (or a producer rib). Thus, steam trap control can be effectively achieved due to lateral steam override even if the injector is at the same elevation or even lower than the producer. This steam override can take place within the open-hole rib, or within the reservoir matrix, or both.

Figure 8:
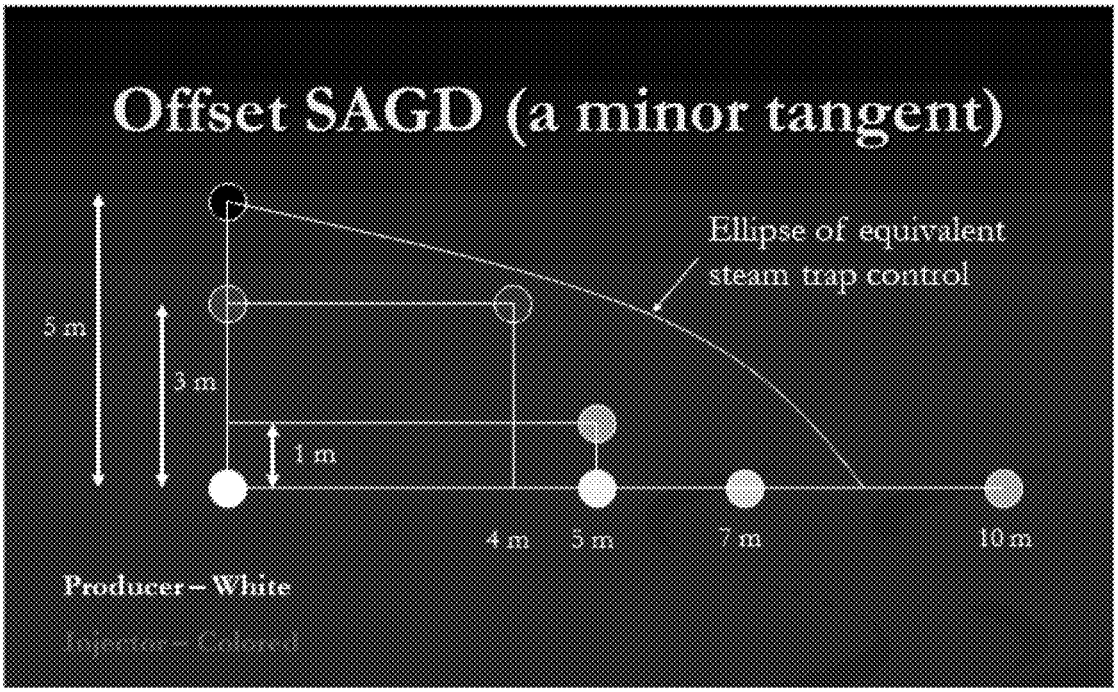
FIG. 8 Offset SAGD simulations.

Simulations with "Offset SAGD" showed that there is an ellipse of equivalent steam trap control such that offsetting parallel injector-producer wells laterally in SAGD can achieve the same steam trap control as 5 m vertical separation. This ellipse showed that 10 m lateral offset and zero vertical offset achieves steam trap control equivalent to 5 m vertical offset with zero lateral offset. Three meter vertical offset with 4 m lateral offset also achieves this level of control, and 1 m vertical offset and 8 m lateral offset works as well. See e.g., FIG. 8. With radial fishbone SAGD, we are considering much greater than 10 m lateral offsets between producers and injectors or their ribs. Therefore, steam trap control should not be an issue.

The steam chamber surface area will also be greatly expanded by the ribs. A classical SAGD steam chamber has the shape of a horizontal cylinder (somewhat tear drop shaped), whereas the ribs in this radial fishbone SAGD will greatly accelerate the lateral growth of the steam chambers along the ribs to create centipede-like chambers, which have much more surface area-to-volume ratio. In this case the steam is contacting much more cold bitumen for a given amount of chamber volume, which translates into more mobilized oil per unit of steam chamber volume and significantly improves the thermal efficiency. This accelerated rate of production will reduce the time that the steam chamber is held at high temperature and therefore the time for heat to be lost to the overburden. All these aspects of this disclosed method contribute to more cost-efficient SAGD operation.

Secondly, since flow distribution control devices may be installed in the base pipe, the toe tubing strings can also be eliminated, thereby allowing drilling holes of smaller diameter and using smaller liners and casings to save well cost. Similarly, well intervention can be simplified by having only one tubing string.

Additionally, fewer wells overall are drilled in this well configuration. This means that the wellhead plumbing, manifolding, control valves and other well pad facilities can be reduced. Also, because the total number of wells drilled is reduced, the cost of production can be brought down significantly.

Because of the simple yet effective well configuration, the drilling trajectories can be simplified, thus enabling drilling longer well length. Also because of the extensive coverage of the formation with open-hole fishbone ribs, the "wedge" oil that is often stranded between conventional SAGD well pairs can now be more easily and quickly developed without drilling additional infill wells, which further lower the production cost.

The above description relates to various embodiments of the present invention. It should be understood that the inventive features and concepts may be manifested in other arrangements and that the scope of the invention is not limited to the embodiments described or illustrated. The scope of the invention is intended to only be limited by the scope of the claims that follow.

The following references are incorporated by reference in their entirety for all purposes.

STALDER J. L., et al., Alternative Well Configurations in SAGD: Rearranging Wells to Improve Performance, presented at 2012 World Heavy Oil Congress [WHOC12], available online at http://www.osli.ca/uploads/files/Resources/Alternative%20Well%20Configurations %20in%20SAGD_WHOC2012.pdf OTC 16244, Lougheide, et al. Trinidad's First Multilateral Well Successfully Integrates Horizontal Openhole Gravel Packs, OTC (2004).

SPE 69700-MS, "Multilateral-Horizontal Wells Increase Rate and Lower Cost Per Barrel in the Zuata Field, Faja, Venezuela", Mar. 12, 2001.

Technical Advancements of Multilaterals (TAML). 2008. http://www.taml.net (accessed 2011).

EME 580 Final Report: Husain, et al., Economic Comparison of Multi-Lateral Drilling over Horizontal Drilling for Marcellus Shale Field (2011), available online at http://www.ems.psu.edu/~elsworth/courses/egee580/2011/Final%20Reports/fishbone_report.pdf U.S. Pat. No. 8,333,245 U.S. Pat. No. 8,376,052 Accelerated production of gas from a subterranean zone US20120247760 Dual Injection Points In SAGD US20110067858 Fishbone Well Configuration For In Situ Combustion US20120227966 In Situ Catalytic Upgrading

The invention claimed is:

1. A well configuration for steam assisted gravity drainage (SAGD) production of hydrocarbons, the well configuration comprising:

a) a central well pad;

b) a plurality of horizontal production wells radiating in a radial pattern from said central well pad at a first depth at or near the bottom of a hydrocarbon play;

c) a plurality of horizontal injection wells radiating from said central well pad at the same or lesser depth than said first depth; and, d) a plurality of horizontal lateral wells originating from said plurality of horizontal production wells or said plurality of horizontal injection wells or both, e) said radial pattern including 6 or more wells radiating from said central well pad.

2. The well configuration of claim 1), wherein said plurality of lateral wells originate from each of said plurality of horizontal production wells.

3. The well configuration of claim 1), wherein said plurality of lateral wells originate from each of said plurality of horizontal production wells and slant upwards towards said plurality of horizontal injection wells.

4. The well configuration of claim 1), wherein said plurality of lateral wells are arranged in an alternating pattern.

5. The well configuration of claim 1), wherein said a plurality of lateral wells originate from each of said plurality of horizontal production wells and are arranged in an alternating pattern.

6. The well configuration of claim 1), wherein said a plurality of lateral wells originate from each of said plurality of horizontal production wells, are arranged in an alternating pattern and slant upwards.

7. The well configuration of claim 1), wherein an injection well and a nearest production well make a wellpair, and wherein said wellpairs are vertically stacked.

8. The well configuration of claim 1), wherein an injection well and a nearest production well make a wellpair, and wherein said wellpairs are offset stacked.

9. The well configuration of claim 1), wherein an injection well and a nearest production well make a wellpair, and wherein said wellpairs are at the same depth.

10. An improved method of SAGD, SAGD comprising a lower horizontal production well, a higher horizontal injection well, wherein steam is injected into said injection well to mobilize oil which then gravity drains to said production well, the improvement comprising providing a central wellpad having a hexagonal or greater radial array of wells radiating from said central wellpad, including a plurality of lower horizontal production wells and a plurality of higher horizontal injection wells, said plurality of lower horizontal production wells each also having a plurality of horizontal slanted lateral wells extending upwards towards a nearest higher horizontal injection well.

11. An improved method of SAGD, SAGD comprising a lower horizontal production well, a higher horizontal injection well, wherein steam is injected into said injection well to mobilize oil which then gravity drains to said production well, the improvement comprising providing a central wellpad having a hexagonal or greater radial array of alternating lower horizontal production wells and higher horizontal injection wells radiating from said central wellpad, each of said lower horizontal production wells each also having a plurality of horizontal lateral wells.

12. An improved method of SAGD, SAGD comprising a lower horizontal production well, a higher horizontal injection well, wherein in a preheat step a) steam is injected into each of said wells until fluid communication is established between wells, then in step b) steam is injected into said injection well to mobilize oil which then gravity drains to said production well for production, the improvement comprising providing a central wellpad having a hexagonal or greater radial array of alternating lower horizontal production wells and higher horizontal injection wells radiating from said central wellpad, said lower horizontal production wells each also having a plurality of horizontal lateral wells extending upwards towards a nearest higher horizontal injection well, and wherein a time for the preheat step a) is reduced by 90-100%.

13. An improved method of SAGD, SAGD comprising a horizontal production well, a horizontal injection well, wherein in a preheat step steam is injected into each of said wells until fluid communication is established between wells, wherein after the preheat step steam is injected into said injection well to mobilize oil which then gravity drains to said production well for production, the improvement comprising providing a central wellpad having a hexagonal or greater radial array of horizontal production wells and horizontal injection wells radiating from said central wellpad, said horizontal production wells each also having a plurality of horizontal lateral wells extending towards a nearest horizontal injection well, and wherein a time for the preheat step is reduced by 90-100%.

14. An improved method of steam assisted oil production, wherein in a preheat step a) steam is injected into each of said wells for a period of time until fluid communication is established between wells, wherein after the preheat step steam is injected into said injection well to mobilize oil, which is then driven to said production well for production, the improvement comprising providing a radial fishbone pattern of hexagonal or greater radially arranged alternating production wells and injection wells radiating from a central wellpad, some of said wells each also having a plurality of horizontal lateral wells extending towards a nearest neighbor well, and wherein said period of time for preheat step a) is reduced.

15. A method of SAGD production of hydrocarbons, said method comprising a) providing a well configuration as recited in claim 1; b) injecting steam into each of said plurality of injection wells; c) heating hydrocarbons to produce mobilized hydrocarbons; and, d) producing said mobilized hydrocarbons from said plurality of production wells.

* * * * *